US009259776B2

(12) United States Patent
Morishita et al.

(10) Patent No.: US 9,259,776 B2
(45) Date of Patent: Feb. 16, 2016

(54) MANUFACTURING APPARATUS FOR HEAT EXCHANGER FINS

(71) Applicant: Hidaka Seiki Kabushiki Kaisha, Tokyo (JP)

(72) Inventors: Keiichi Morishita, Tokyo (JP); Yoshitaka Ide, Tokyo (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 244 days.

(21) Appl. No.: 13/939,876

(22) Filed: Jul. 11, 2013

(65) Prior Publication Data

US 2014/0123480 A1 May 8, 2014

(30) Foreign Application Priority Data

Nov. 8, 2012 (JP) ..... 2012-246441

(51) Int. Cl.

| | |
|---|---|
| ***B21D 53/02*** | (2006.01) |
| *B21D 43/02* | (2006.01) |
| *B21D 43/04* | (2006.01) |
| *B21D 43/28* | (2006.01) |

(52) U.S. Cl.

CPC ..... *B21D 53/022* (2013.01); *B21D 43/02* (2013.01); *B21D 43/021* (2013.01); *B21D 43/023* (2013.01); *B21D 43/028* (2013.01); *B21D 43/04* (2013.01); *B21D 43/287* (2013.01); *Y10T 29/4938* (2015.01); *Y10T 29/49359* (2015.01); *Y10T 29/5197* (2015.01); *Y10T 29/5198* (2015.01); *Y10T 29/53122* (2015.01)

(58) Field of Classification Search

CPC .... B21D 43/022; B21D 43/026; B21D 43/11; B21D 43/006; B21D 43/02; B21D 43/021; B21D 43/027; B21D 43/04; B21D 43/05; B21D 43/10; Y10T 29/49359; Y10T 29/4938; Y10T 29/49373; Y10T 29/49378; Y10T 29/5198; Y10T 29/5197

See application file for complete search history.

(56) References Cited

U.S. PATENT DOCUMENTS

| | | | | | |
|---|---|---|---|---|---|
| 3,023,976 | A | * | 3/1962 | Paquay | 242/418.1 |
| 3,512,438 | A | * | 5/1970 | Burdge | 83/209 |
| 3,839,974 | A | * | 10/1974 | Freres | 72/185 |

FOREIGN PATENT DOCUMENTS

| | | | |
|---|---|---|---|
| JP | 2006-150455 | A | 6/2006 |
| JP | 3881991 | B2 | 2/2007 |
| JP | 2012-183554 | A | 9/2012 |
| KR | 10-2007-0004404 | A | 1/2007 |

* cited by examiner

*Primary Examiner* — Jason L Vaughan

(74) *Attorney, Agent, or Firm* — Birch, Stewart, Kolasch & Birch, LLP

(57) ABSTRACT

A manufacturing apparatus for heat exchanger fins is provided that can prevent deformation of a metal strip when the metal strip is conveyed by a feeding pin.

In a manufacturing apparatus for heat exchanger fins, including a press apparatus having a mold that forms a metal strip by pressing a plurality of through-holes or a plurality of cutaway portions on a thin metal plate and a first feeding apparatus arranged on the downstream side of the mold for conveying the metal strip formed by the mold to the downstream side in the conveying direction, a second feeding apparatus that conveys a thin metal plate before press working by the mold into the mold in synchronization with a conveying operation of the first feeding apparatus is provided on the upstream side of the press apparatus.

3 Claims, 9 Drawing Sheets

CONVEYING DIRECTION
45
45a
41
45b
47
47a
47b

CLOSE MOVABLE CLAMPER
AND OPEN FIXED CLAMPER
47a
41
45a
45b
47b

SANDWICH THIN PLATE
BY MOVABLE CLAMPER AND FEED
45a
41
47a
45b
47b

CLOSE FIXED CLAMPER
AND OPEN MOVABLE CLAMPER
45a
41
47a
47b

45b
RETURN WHILE MOVABLE CLAMPER IS OPEN

CONVEYING DIRECTION 41
44
95
75
46
50
49
97
76
C
OPERATION

MANUFACTURING APPARATUS FOR HEAT EXCHANGER FINS

CROSS-REFERENCE TO RELATED APPLICATION(S)

This application is based upon and claims the benefit of priority of the prior Japanese Patent Application No. 2012-246441, filed on Nov. 8, 2012, the entire contents of which are incorporated herein by reference.

FIELD

The present invention relates to a manufacturing apparatus for fins used for a heat exchanger.

BACKGROUND

A heat exchanger, such as an air conditioner, is typically constructed by stacking a plurality of heat exchanger fins, in which a plurality of through-holes is drilled to enable heat exchanger tubes to be inserted.

Such heat exchanger fins are manufactured by a manufacturing apparatus for heat exchanger fins illustrated in FIG. 7.

The manufacturing apparatus for heat exchanger fins is equipped with an uncoiler 12 where a thin metal plate (metal strip) 10 made of aluminum or the like has been wound into a coil. The metal strip 10 pulled out from the uncoiler 12 via pinch rollers 14 is inserted into an oil applying apparatus 16 where machining oil is applied onto the surface of the metal strip 10, and is then supplied to a mold 20 provided inside a press apparatus 18.

The mold 20 internally includes an upper mold die set 22 capable of up-down movement and a lower mold die set 24 that is static. In the metal strip 10 having passed through this mold 20, a plurality of collar-equipped through-holes 15 (also referred to simply as through-holes in the present specification in some cases), where collars of a predetermined height are formed around the drilled through-holes, are formed at predetermined intervals in a predetermined direction.

Such metal strip 10 is, after being conveyed in a predetermined direction for a predetermined distance, cut into a predetermined length by a cutter 26 and then accommodated in a stacker 28.

In a press apparatus 18, a feeding apparatus 31 that intermittently conveys the metal strip 10 in which the plurality of through-holes 15 is formed at the predetermined intervals in the predetermined direction is provided in a direction of a cutter 26.

As illustrated in FIG. 8, the feeding apparatus 31 conveys the metal strip 10 in the conveying direction by causing a feeding pin 29 to enter the through-hole 15 formed in the metal strip 10 from below and moving the feeding pin 29 in the conveying direction.

As illustrated in FIG. 9, when the metal strip 10 has been conveyed to a predetermined position, the feeding pin 29 is lowered and removed from the inside of the through-hole 15. Then, the feeding pin 29 moves in a direction opposite to the conveying direction (return direction) so as to return to an initial position while keeping a position not in contact with the metal strip 10.

CITATION LIST

Patent Document

Patent Document 1
Japanese Patent No. 3881991

SUMMARY

Problems to be Solved by the Invention

As described above, in the manufacturing apparatus for heat exchanger fins, a feeding apparatus is provided that inserts a feeding pin into a through hole of the metal strip in the press apparatus and conveys the metal strip by the feeding pin.

However, when the feeding pin is inserted into the through-hole and the metal strip is conveyed, there is a problem that a great load is applied to the through-hole, which may promote deformation of not only the through-hole but also the metal strip.

Moreover, when the feeding apparatus is provided on the downstream side of the mold and the metal strip is conveyed, if a tension is not applied to an unmachined metal thin plate on the upstream side of the mold, there is a problem that the thin plate is deflected in the mold and machining accuracy is lowered.

As described above, in addition to the heat exchanger in which a plurality of through-holes into which a heat exchanger tube is inserted is drilled in the metal strip, a heat exchanger using a multi-hole flattened tube has been developed. This heat exchanger fin using the flattened tube (hereinafter also referred to as flattened tube fin) is illustrated in FIGS. 10A and 10B.

On a flattened tube fin 30, cutaway portions 34 into which the flattened tube 11 is inserted are formed at a plurality of positions, and plate-like portions 36, where louvers 35 are formed, are formed between the cutaway portions 34.

The cutaway portions 34 are formed from only one side in the width direction of the flattened tube fin 30. Therefore, the plurality of plate-like portions 36 between the cutaway portions 34 is joined by a joining portion 38 that extends in the longitudinal direction.

When such flattened tube fin is manufactured, too, the feeding pin of the feeding apparatus is inserted into the cutaway portion, and the metal strip before the flattened tube fin is completed is conveyed by the feeding pin. When the feeding pin is inserted into the cutaway portion and the metal strip is conveyed as above, too, there is a problem that a great load is applied to the cutaway portion, which may promote deformation of not only the cutaway portion but also the metal strip, and there is also a problem that if a tension is not applied to the unmachined metal thin plate on the upstream side of the mold, the thin plate is deflected in the mold and machining accuracy is lowered.

Therefore, the present invention has been made to solve the problems described above and has an object of providing a manufacturing apparatus for heat exchanger fins that can prevent deformation of a metal strip when the metal strip is conveyed by a feeding pin.

Means for Solving the Problems

According to a manufacturing apparatus for heat exchanger fins according to the present invention, in a manufacturing apparatus for heat exchanger fins, including a press apparatus having a mold that forms a metal strip by pressing a plurality of through-holes or a plurality of cutaway portions on a thin metal plate and a first feeding apparatus arranged on the downstream side of the mold for conveying the metal strip formed by the mold to the downstream side in the conveying direction, a second feeding apparatus that conveys a metal thin plate before press working by the mold into the mold in synchronization with a conveying operation of the first feeding apparatus is provided on the upstream side of the press apparatus.

By employing this configuration, though a great load is applied to the metal strip in conveyance only by the first feeding apparatus, the metal thin plate is fed in the mold direction by the second feeding apparatus, and a load on the metal strip by the first feeding apparatus can be reduced, and deformation of the metal strip can be prevented.

Moreover, the second feeding apparatus has clampers which sandwich the thin metal plate, the clampers may repeat an operation of sandwiching the thin metal plate, conveying it in the conveying direction, releasing the sandwiching at a predetermined position, and returning to an initial position while avoiding contact with the thin metal plate.

According to this configuration, the thin metal plate in which through-holes or cutaway portions are not formed yet can be reliably conveyed.

Moreover, a control unit may be provided that executes control so that the second feeding apparatus starts a conveying operation before the first feeding apparatus starts the conveying operation.

According to this configuration, before the first feeding apparatus conveys the metal strip, the metal thin plate is fed by the second feeding apparatus, and thus, the thin plate is deflected once on the upstream side from the mold and then, the first feeding apparatus pulls the metal strip so as to eliminate the flexure, and the load on the metal strip by the first feeding apparatus can be further reduced.

Moreover, between the second feeding apparatus and the press apparatus, an upper-surface holding member in contact with an upper surface of the thin metal plate before entering the press apparatus and a lower-surface holding member in contact with a lower surface of the thin metal plate before entering the press apparatus may be arranged with a predetermined distance therebetween in the conveying direction, and the positions in the vertical direction of the upper-surface holding member and the lower-surface holding member are set so that flexure is generated in the thin metal plate having been conveyed by the second feeding apparatus between the upper-surface holding member and the lower-surface holding member.

According to this configuration, flexure is generated between the upper-surface holding member and the lower-surface holding member in the thin metal plate before entering the mold. Since the metal strip in the mold is pulled in the conveying direction by the first feeding apparatus, flexure can be prevented in the mold.

Advantageous Effect of the Invention

According to the present invention, a heat exchanger fin can be manufactured so that the metal strip is not deformed without applying an excessive load on the metal strip by the feeding pin.

DESCRIPTION OF THE PREFERRED EMBODIMENTS

Figure 1:
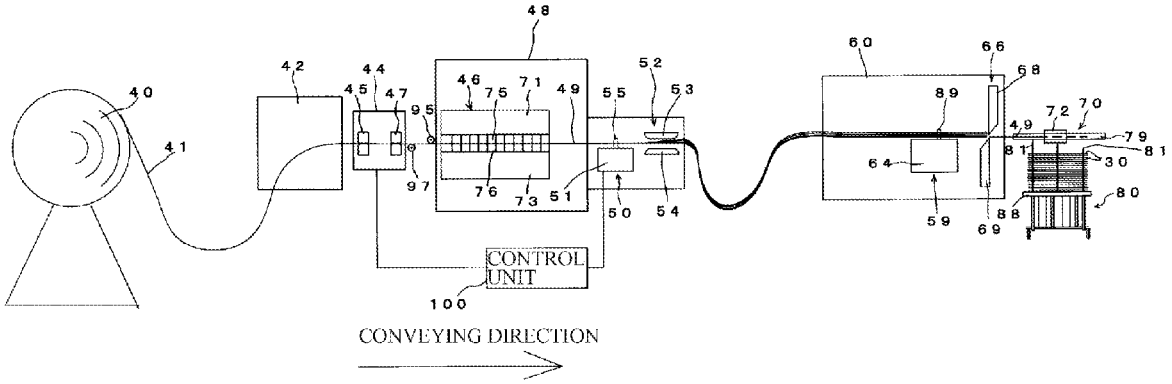
FIG. 1 is an explanatory diagram illustrating an entire configuration of a manufacturing apparatus for heat exchanger fins according to the present invention.

An outline configuration of an entire manufacturing apparatus for heat exchanger fins according to the present invention is illustrated in FIG. 1. The manufacturing apparatus for heat exchanger fins described below is a manufacturing apparatus for flattened tube fins (See FIGS. 10A and 10B) in each of which a cutaway portion is formed as an example.

A thin metal plate 41 that is made of aluminum or the like and is yet to be machined is wound in a coil state in an uncoiler 40. The thin plate 41 pulled out from the uncoiler 40 is inserted into a loop controller 42 and fluctuations in the thin plate 41 that is intermittently fed are suppressed by the loop controller 42.

A gripper feeder 44 as an example of a second feeding apparatus is provided on the downstream side of the loop controller 42.

The gripper feeder 44 will be described on the basis of FIG. 2.

In the gripper feeder 44, two clampers 45 and 47 sandwiching the thin plate 41 in the vertical direction are provided. In the two clampers in the gripper feeder 44, the fixed clamper 47 not moving in the conveying direction is provided on the downstream side in the conveying direction (the side closer to a mold 46, which will be described later), and the movable clamper 45 moving in the conveying direction is provided on the upstream side in the conveying direction. The movable clamper 45 corresponds to a clamper referred to in the claim.

The movable clamper 45 has an upper clamper 45*a* located on the upper surface side of the thin plate 41 and brought into contact with the upper surface of the thin plate 41 and a lower clamper 45*b* located on the lower surface side of the thin plate 41 and brought into contact with the lower surface of the thin plate 41. Both for the upper clamper 45*a* and the lower clamper 45*b*, those with a material of iron or urethane, etc. can be employed.

Figure 2:
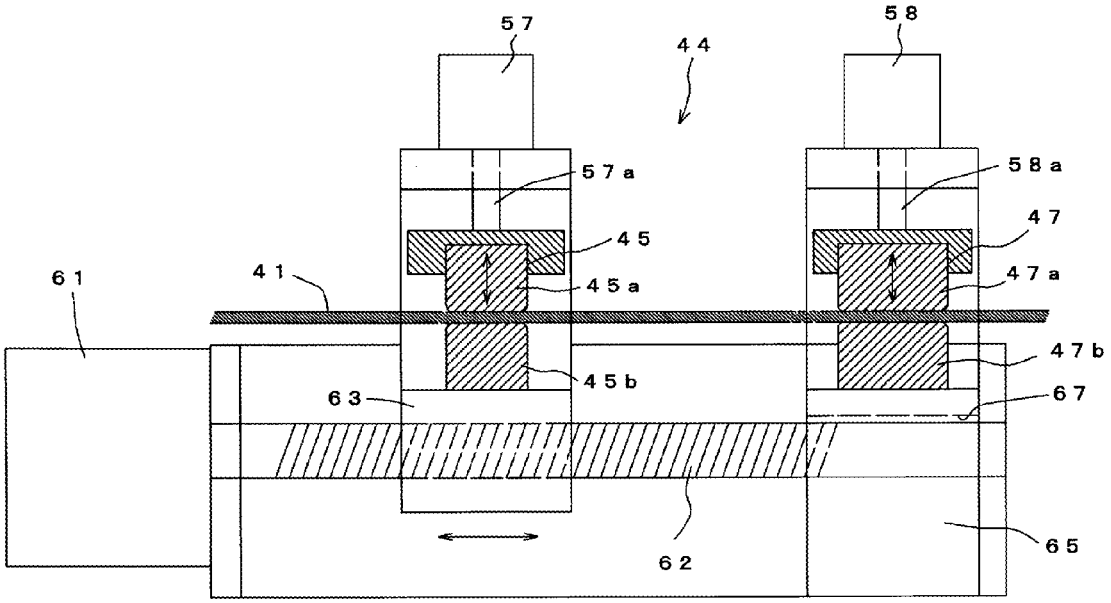
FIG. 2 is a side view of a gripper feeder.

In the embodiment illustrated in FIG. 2, the movable clamper 45 is provided so that the upper clamper 45*a* is vertically movable. The lower clamper 45*b* does not move vertically but stays in a state in contact with the lower surface of the thin plate 41 all the time.

For the vertical movement of the upper clamper 45*a* in the movable clamper 45, vertically moving device is provided on the upper clamper 45*a*. As an example of the vertically moving device, an air cylinder 57 can be used. A rod 57*a* of the air cylinder 57 is mounted on the upper clamper 45*a*, and the upper clamper 45*a* can approach to/separate from the thin plate 41 by the operation of the air cylinder 57.

Moreover, similarly to the movable clamper 45, the fixed clamper 47 has an upper clamper 47*a* located on the upper surface side of the thin plate 41 and brought into contact with the upper surface of the thin plate 41 and a lower clamper 47*b* located on the lower surface side of the thin plate 41 and brought into contact with the lower surface of the thin plate 41. Both for the upper clamper 47*a* and the lower clamper 47*b*, those with a material of iron or urethane, etc. can be employed.

In the embodiment illustrated in FIG. 2, the fixed clamper 47 is provided so that the upper clamper 47*a* is vertically movable. The lower clamper 47*b* does not move vertically but stays in a state in contact with the lower surface of the thin plate 41 all the time.

For the vertical movement of the upper clamper 47*a* in the fixed clamper 47, vertically moving device is provided on the upper clamper 47*a*. As an example of the vertically moving device, an air cylinder 58 can be used. A rod 58*a* of the air cylinder 58 is mounted on the upper clamper 47*a*, and the upper clamper 47*a* can approach to/separate from the thin plate 41 by the operation of the air cylinder 58.

Subsequently, a method of moving the movable clamper 45 in the conveying direction will be described.

In the movable clamper 45, reciprocating device capable of reciprocating the movable clamper 45 in the conveying direction is provided. As an example of the reciprocating device, a servo motor 61 and a ball screw 62 can be employed.

In the present embodiment, the lower clamper 45*b* of the movable clamper 45 is arranged on the upper surface of a moving base 63, and the moving base 63 is provided so as to make linear motion with respect to rotary motion of the ball screw 62. The ball screw 62 is arranged so that the axis thereof is in the same direction as the conveying direction. A servo motor 61 is mounted on either one of end portions of the ball screw 62, and the ball screw 62 is rotated by driving of the servo motor 61.

Moreover, the moving base 63 is extended above the thin plate 41 from the side of the thin plate 41, and the upper clamper 45*a* and the air cylinder 57 are mounted thereon. Therefore, in accordance with the reciprocal movement of the moving base 63 in the conveying direction, the upper clamper 45*a*, the air cylinder 57, and the lower clamper 45*b* can reciprocate in the conveying direction integrally with the moving base 63.

The lower clamper 47*b* of the fixed clamper 47 is arranged on the upper surface of a fixed base 65. In the fixed base 65, a through-hole 67 penetrated so as not to contact the ball screw 62 is formed so that it is not affected by rotation of the ball screw 62.

FIG. 3 illustrates an operation of the gripper feeder 44.

Figures 3A, 3B, 3C, 3D:
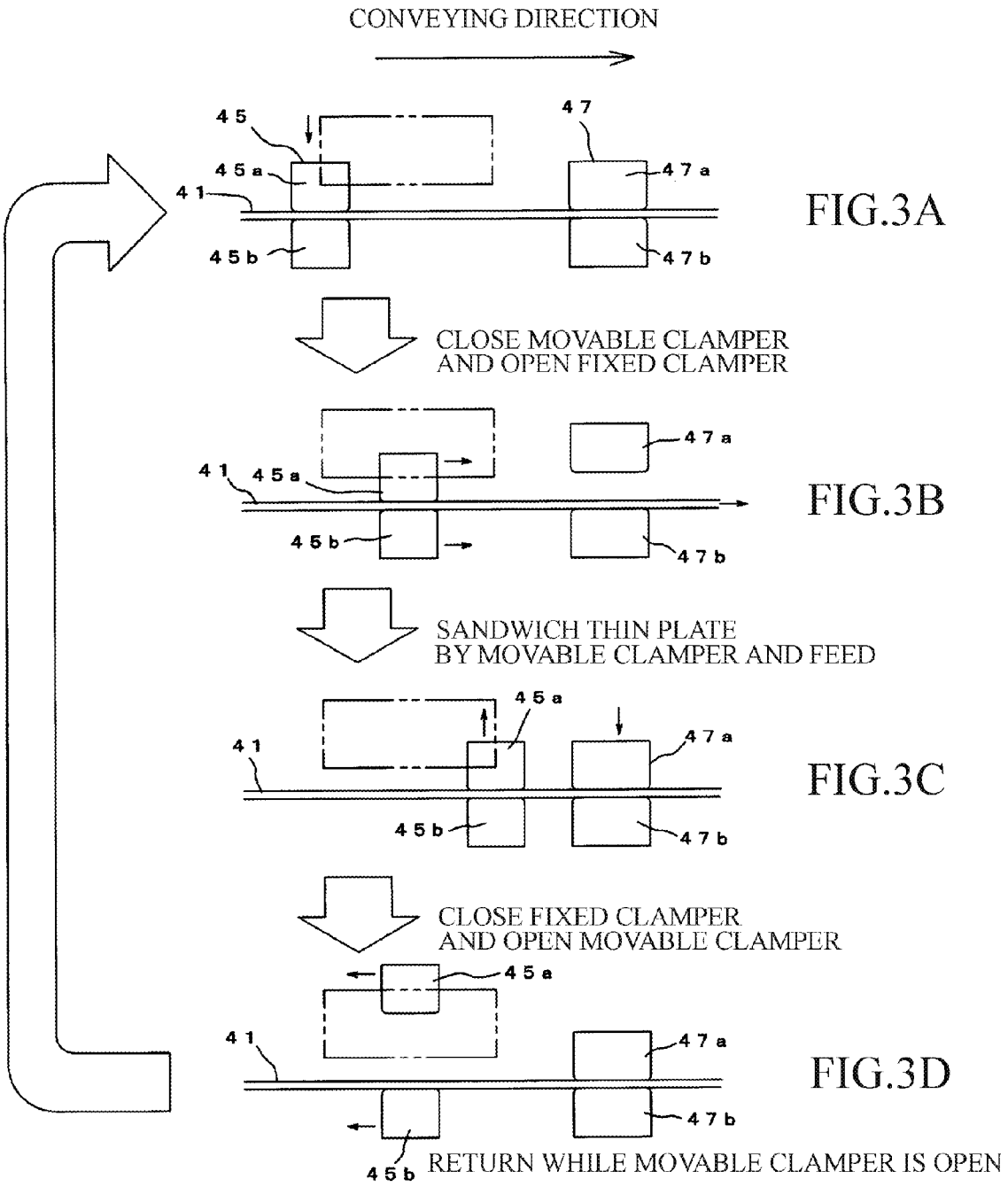
FIGS. 3A to 3D are an explanatory diagram of a feeding operation of a thin plate by the gripper feeder.

FIG. 3A illustrates a state in which both the movable clamper 45 and the fixed clamper 47 clamp the thin plate 41.

Subsequently, as in FIG. 3B, the fixed clamper 47 opens, and the movable clamper 45 moves in the conveying direction while clamping the thin plate 41. As a result, the thin plate 41 can be moved in the conveying direction.

In FIG. 3C, a state where the conveyance is completed is illustrated. When the conveyance is completed, the movable clamper 45 opens and releases clamping of the thin plate 41. Along with the release of clamping of the movable clamper 45, the fixed clamper 47 closes and clamps the thin plate 41. As a result, the thin plate 41 is fixed at a conveyance position.

Then, as illustrated in FIG. 3D, the movable clamper 45 returns to a position of A, that is, a conveyance start position while being open.

Note that, in order to clamp the thin plate by the movable clamper 45 and the fixed clamper 47, the air cylinder was cited as an example of the vertical moving device for driving each of the upper clampers 45*a* and 47*a*, but the vertical moving device is not limited to the air cylinder, but a hydraulic cylinder or a cam-type cylinder can be employed.

Moreover, in the present embodiment, the side arranged on the upper surface side of the thin plate 41 is made movable in the vertical direction along with the movable clamper 45 and the fixed clamper 47. However, the side arranged on the lower surface side of the thin plate 41 may be configured to be movable in the vertical direction along with the movable clamper 45 and the fixed clamper 47 so as to clamp the thin plate 41.

Moreover, as the reciprocating device that reciprocates the movable clamper 45 in the conveying direction, use of the servo motor and the ball screw is not limiting but a configuration such as an air cylinder, a hydraulic cylinder, a cam-type cylinder and the like may be employed.

Subsequently, returning to FIG. 1, a configuration of the downstream side of the gripper feeder 44 as an example of the second feeding apparatus will be described.

On the downstream side in the conveying direction of the gripper feeder 44, an upper-surface holding member 95 brought into contact with the upper surface of the thin plate 41 before entering the press apparatus 48 and a lower-surface holding member 97 brought into contact with the lower surface of the thin plate 41 before entering the press apparatus are arranged with a predetermined distance therebetween in the conveying direction.

In the present embodiment, the upper-surface holding member 95 and the lower-surface holding member 97 both employ rollers.

The upper-surface holding member 95 is in contact with the upper surface of the thin plate 41 all the time, and the lower-surface holding member 97 is in contact with the lower surface of the thin plate 41 all the time. The upper-surface holding member 95 and the lower-surface holding member 97 are provided in order to form flexure in the thin plate 41 before entering the press apparatus 48. An action of the flexure will be described later.

Moreover, in the present embodiment, the lower-surface holding member 97 is arranged on the upstream side and the upper-surface holding member 95 on the downstream side, but the lower-surface holding member 97 may be arranged on the downstream side and the upper-surface holding member 95 on the upstream side.

On the downstream side of the gripper feeder 44, the press apparatus 48 in which the mold 46 is arranged is provided. In the press apparatus 48, the thin plate 41 is formed into a metal strip 49 having a predetermined shape by the mold 46.

The mold 46 includes an upper die set 71 and a lower die set 73, at least either of which is vertically movable. On the upper die set 71 and the lower die set 73, an upper die 75 and a lower die 76 provided facing each other are provided.

On the upper die 75 and the lower die 76, a machining tool such as a punch, a die and the like for forming a flattened tube fin is provided.

Figure 4:
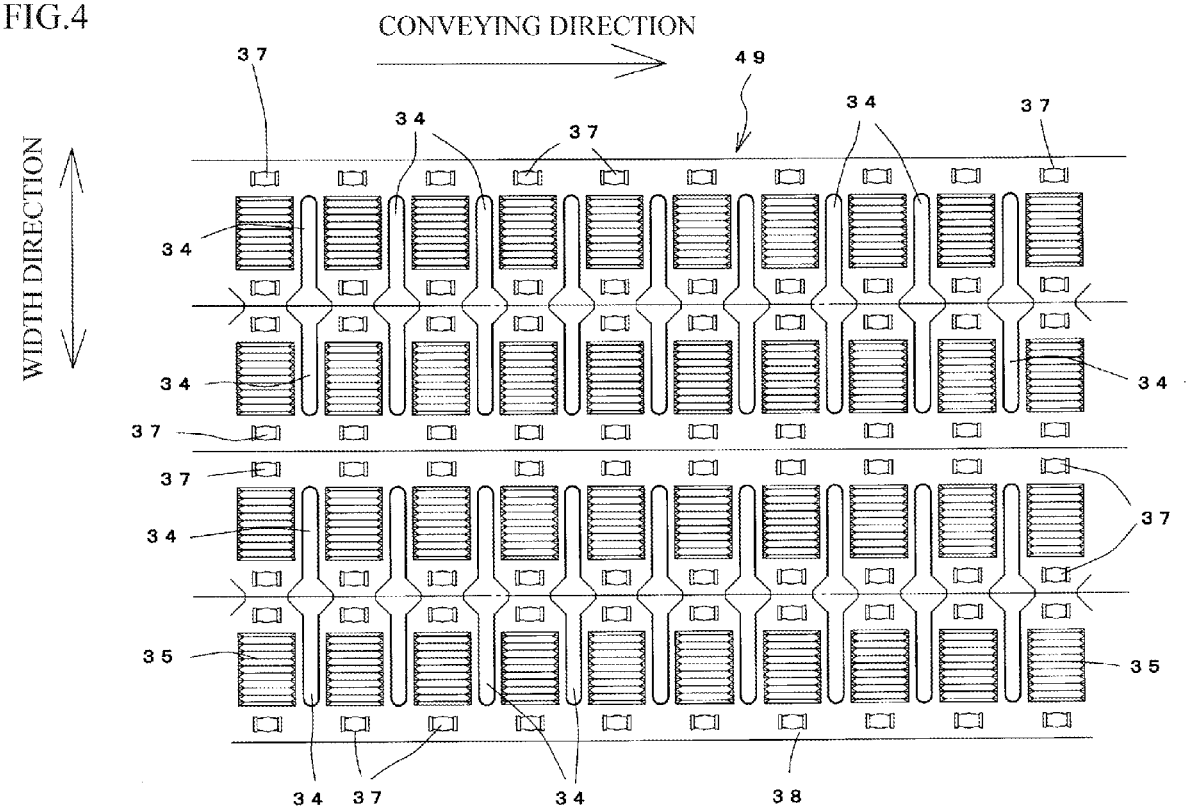
FIG. 4 is a plan view of a metal strip machined by a mold.

The metal strip 49 formed in the press apparatus 48 is illustrated in FIG. 4. The metal strip 49 illustrated in FIG. 4 is formed such that four products are juxtaposed in a product width direction orthogonal to the conveying direction.

Figure 10A:
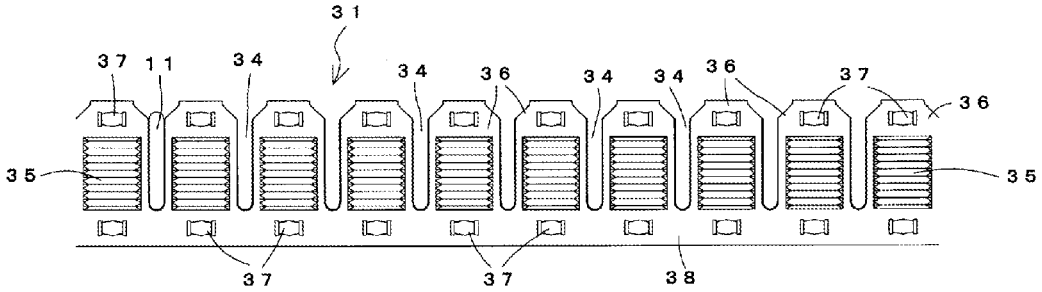
FIG. 10A is a plan view of a flattened tube fin.
Figure 10B:
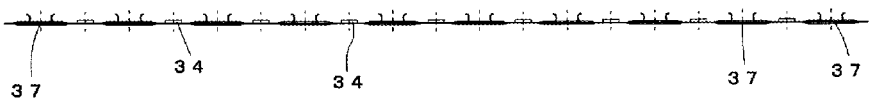
FIG. 10B is a side view of the flattened tube fin.

As for a specific product obtained from the metal strip 49, as illustrated in FIG. 10A, the cutaway portions 34 into which the flattened tube 11 is inserted are formed at a plurality of positions, and the plate-like portion 36, where the louver 35 is formed, is formed between the cutaway portions 34. Moreover, on the both end portion sides in the width direction of the louver 35, openings 37 formed by cutting and raising the thin metal plate are formed. In the two openings 37 and 37 for one louver 35, the opening 37 on one side is formed on the distal end portion side of the plate-like portion 36.

The cutaway portion 34 is formed only from one side in the width direction of the flattened tube fin 30. Therefore, the plurality of plate-like portions 36 between the cutaway portions 34 is joined by the joining portion 38 extending continuously in the longitudinal direction.

In the two openings 37 and 37 for the above-described one louver 35, the opening 37 on the other side is formed on this joining portion 38.

On the metal strip 49 illustrated in FIG. 4, two products disposed in a face-to-face manner with the open sides of the cutaway portions 34 adjacent to each other form a pair, and two pairs are formed. That is, the pairs, in each of which the open sides of the cutaway portions 34 of two products are disposed in a face-to-face manner, are placed so that the joining portions 38 thereof are adjacent.

In this way, by disposing four products so as to face one another, the left-right load balance of the mold is improved.

Note that, unlike a metal strip such as that illustrated in FIG. 4, if the open sides of all the cutaway portions 34 of a plurality of products were disposed so as to face in one direction, when cutting is carried out between the products by an inter-row slit apparatus 52 (will be described later) that cuts out the respective products, there would be a high probability that cutting fragments (whiskers: cutting defects) would be produced between the cutaway portions 34 and the other portions due to displacements in the cutting position. Accordingly, when all of the open sides of the cutaway portions 34 of a plurality of products are disposed so as to face in one direction, it becomes necessary not to cut at the boundary of the openings of the cutaway portions 34 but to slightly extend the opening parts of the cutaway portions 34 as far as a position entering a part of the joining portion 38 and to perform cutting. However, in such case, the cross-section becomes stepped and there is deterioration in the left-right load balance of the mold. Accordingly, it is preferable to manufacture a plurality of products with the arrangement depicted in FIG. 4.

The description will now return to the entire configuration of the manufacturing apparatus for flattened tube fins.

As illustrated in FIG. 1, the metal strip 49 formed by the mold 46 in the press apparatus 48 is conveyed in the conveying direction intermittently by a first feeding apparatus 50 provided on the downstream side of the press apparatus 48.

The feed timing of the first feeding apparatus 50 is provided so as to operate in concert with the gripper feeder 44 by control of a control unit 100 which will be described later and enables stable intermittent feeding.

In the first feeding apparatus 50, a reciprocating unit 51 that is capable of moving in the horizontal direction reciprocates between an initial position and a conveyed position to pull the metal strip 49. feed pins 55 that protrude upward are disposed on the upper surface of the reciprocating unit 51, the feed pins 55 enter from below the cutaway portions 34 formed in the metal strip 49, and the metal strip 49 is moved to the conveyed position by pulling with the feed pins 55.

Subsequently, a specific configuration and operation of the first feeding apparatus 50 will be described on the basis of FIGS. 5A to 5E.

Figure 5A:
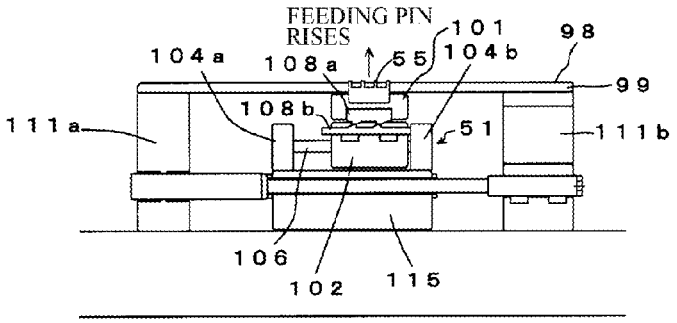
FIGS. 5A to 5E are explanatory diagrams for explaining a configuration and an operation of the first feeding apparatus.
Figure 5B:
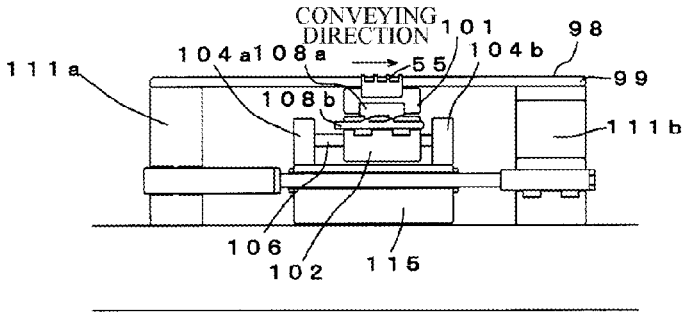
Figure 5C:
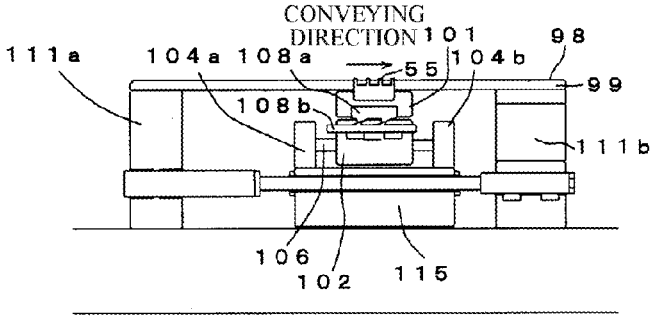

FIG. 5A illustrates a state where the feed pin 55 is at the initial position and conveying is to be started. FIGS. 5B to 5C illustrate a state during conveyance. FIG. 5E illustrates a state where the feed pin 55 is lowered at an end position in the conveying direction.

The metal strip 49 is placed from the mold 46 onto a reference plate 98. In the reference plate 98, a slit 99 opened in a range where the feed pin 55 moves is formed. Through this slit 99, the feed pin 55 protrudes upward.

The reciprocating unit 51 has a pin block 101, a moving block 102, and a reciprocating block 115.

The feed pins 55 are provided on the pin block 101 which is movable in the horizontal direction and the vertical direction so as to protrude upward.

If the metal strip 49 is to be conveyed in the conveying direction, the pin block 101 rises, and the feed pin 55 enters the cutaway portion 34 in the metal strip 49 placed on the reference plate 98. Then, the pin block 101 moves in the conveying direction. After the metal strip 49 is moved to the predetermined position, the pin block 101 lowers, and the feed pin 55 pulls out downward from the cutaway portion 34. Then, the pin block 101 moves in a direction opposite to the conveying direction (return direction) so as to return to the initial position while keeping the position where the feed pin 55 does not contact the metal strip 49.

The moving block 102 is provided below the pin block 101. Additionally, the reciprocating block 115 is provided below the moving block 102.

The reciprocating block 115 is mounted on a shaft (not shown) arranged between two fixed blocks 111*a* and 111*b* arranged facing each other in the conveying direction.

The reciprocating block 115 is connected to a crank (not shown: which converts a vertical movement of the press apparatus 48 to an operation in a rotating direction and converts the operation in the rotating direction to a reciprocating motion in the conveying direction) rotating in synchronization with the press apparatus 48 and reciprocates in the conveying direction by the operation of this crank.

On the both end portions in the conveying direction on the upper surface of the reciprocating block 115, two fixed members 104*a* and 104*b* extending upward are provided. A shaft 106 having an axis in the conveying direction is extended between the two fixed members 104*a* and 104*b*. The moving block 102 is mounted on the shaft 106 so as to become movable in the axial direction of the shaft 106.

In addition, the pin block 101 is biased below (on the moving block 102 side) by a biasing device such as a spring, not shown, and mounted on the moving block 102. Thus, the pin block 101 is movable along with the moving block 102, and when an upward force against the biasing force of the biasing device acts on the pin block 101, the pin block 101 rises to the reference plate 98 side.

Between the moving block 102 and the pin block 101, a vertical cam portion 108 for vertical movement of the pin block 101 is provided.

The vertical cam portion 108 is composed of an upper cam portion 108*a* fixed on the pin block 101 side and a lower cam portion 108*b* provided on the moving block 102 side. An irregular portion is formed on each of opposing surfaces of the upper cam portion 108*a* and the lower cam portion 108*b*.

The lower cam portion 108*b* is arranged on the moving block 102 located between the fixed members 104*a* and 104*b* and is formed so that the length thereof in the conveying direction is longer than that of the moving block 102 in the conveying direction. That is, the lower cam portion 108*b* is formed to be larger in size so as to protrude toward the both end portion sides in the conveying direction than the moving block 102 and the pin block 101.

The irregular portion of the upper cam portion 108*a* is formed on the opposing surface facing the lower cam portion 108*b*. Moreover, the lower cam portion 108*b* is slidable on the moving block 102 and its movement is restricted by the fixed members 104*a* and 104*b*.

That is, if an inner wall surface of the fixed member 104*a* is brought into contact with the side end portion in the direction opposite to the conveying direction of the lower cam portion 108*b*, the lower cam portion 108*b* slides in the conveying direction. If the inner wall surface of the fixed member 104*b* is brought into contact with the side end portion in the conveying direction of the lower cam portion 108*b*, the lower cam portion 108*b* slides in the direction opposite to the conveying direction.

Figure 5D:
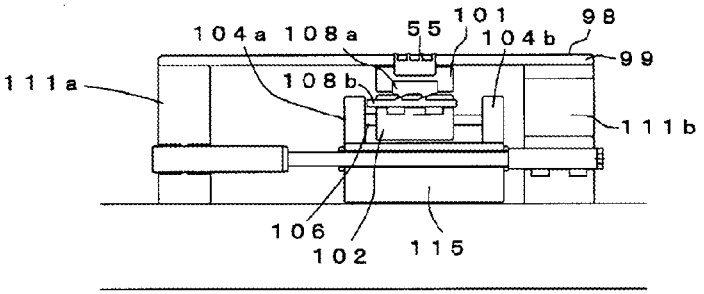
Figure 5E:
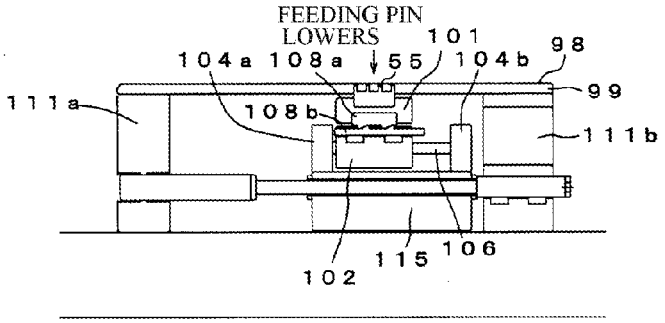

As illustrated in FIGS. 5D and 5E, if the moving block 102 moves to the end position in the conveying direction and stops operation, the wall surface without the fixed member 104*a* mounted on the reciprocating block 115 operating with a delay is brought into contact with the side end portion in the direction opposite to the conveying direction of the lower cam portion 108*b*.

At this time, a recess portion and a projecting portion formed on the upper cam portion 108*a* and the lower cam portion 108*b* are fitted with each other.

That is, at the end position in the conveying direction, the pin block 101 is pressed onto the moving block 102 by the biasing force of the biasing device, and the distal end portion of the feed pin 55 of the pin block 101 is pulled below out of the cutaway portion 34 of the metal strip 49 placed on the reference plate 98.

Then, if the reciprocating block 115 moves in the direction opposite to the conveying direction, the feed pin 55 returns to the initial position in a state of being located below the metal strip 49. However, the reciprocating block 115 returns to the initial position later than the moving block 102.

Thus, as illustrated in FIG. 5A, if the moving block 102 moves to the initial position in the conveying direction and stops operation, the inner wall surface of the fixed member 104*b* mounted on the reciprocating block 115 operating with a delay is brought into contact with the side end portion in the conveying direction of the lower cam portion 108*b*.

At this time, the projecting portions formed on the upper cam portion 108*a* and the lower cam portion 108*b* are brought into contact with each other. Therefore, the pin block 101 is raised upward against the biasing force of the biasing device, and the distal end portion of the feed pin 55 provided on the pin block 101 enters the cutaway portion 34 of the metal strip 49 placed on the reference plate 98.

After the feed pin 55 enters the cutaway portion 34 of the metal strip 49, the reciprocating block 115 moves in the conveying direction, and the feed pin 55 pulls the metal strip 49 in the conveying direction.

Subsequently, returning to FIG. 1, the configuration of the downstream side of the first feeding apparatus 50 will be described.

On the downstream side of the feeding apparatus 50, the inter-row slit apparatus 52 is provided. The inter-row slit apparatus 52 has an upper blade 53 disposed on the upper surface side of the metal strip 49 and a lower blade 54 disposed on the lower surface side of the metal strip 49. The inter-row slit apparatus 52 may be provided so as to operate using an up-down movement operation of the press apparatus 48.

The upper blade 53 and the lower blade 54 are formed so as to be elongated in the conveying direction of the metal strip 49 and the intermittently fed metal strip 49 is cut by the interlocked upper blade 53 and lower blade 54 so as to manufacture products (referred to below as "metal strips having the product width" in some cases) in the form of strips long in the conveying direction.

The plurality of metal strips 49 having the product width that has been cut to the product width by the inter-row slit apparatus 52 is fed into a cutoff apparatus 60.

Note that before being fed into the cutoff apparatus 60, the plurality of metal strips 49 having the product width is arranged with a predetermined distance between neighboring metal strips 49 having the product width. Moreover, before being fed into the cutoff apparatus 60, the plurality of metal strips 49 having the product width is allowed to sag downward and to form a buffer portion in order to temporarily accumulate a length that is longer than the length of one conveying operation by the cutoff apparatus 60.

A third feeding apparatus 59 that intermittently conveys the respective metal strips 49 having the product width in the conveying direction is provided inside the cutoff apparatus 60. As the structure of the third feeding apparatus 59, a structure is used in which the length of one feeding operation can be set longer than that in the structure of the first feeding apparatus 50 provided downstream of the press apparatus 48.

The third feeding apparatus 59 has a conveying unit 64 movable in the horizontal direction, and this conveying unit moves by a predetermined distance in the conveying direction to pull the metal strips 49 having the product width from the press apparatus 48 side and push the metal strips 49 to the downstream side of the cutoff apparatus 60. On the upper surface of the conveying unit 64, a plurality of rows of feeding pins 89 aligned in the horizontal direction in a number equal to the number of metal strips 49 having the product width is disposed so as to protrude upward in a state of rows. The feeding pins 89 are inserted from below into the cutaway portions 34 formed in the respective metal strips 49 having the product width, and due to being pulled by the feeding pins 89, the respective metal strips 49 having the product width move as far as a conveyed position.

A cutting apparatus 66 is provided downstream of the third feeding apparatus 59 in the cutoff apparatus 60.

The cutting apparatus 66 cuts the respective metal strips 49 having the product width into predetermined length to produce the flattened tube fins 30. The cutting apparatus 66 includes an upper blade 68 disposed on the upper surface side of the respective metal strips 49 having the product width and the lower blade 69 disposed on the lower surface side of the respective metal strips 49 having the product width.

By mold-closing the upper blade 68 and the lower blade 69, the respective metal strips 49 having the product width are cut into predetermined length in the conveying direction to manufacture the flattened tube fins 30.

On the downstream side of the cutoff apparatus 60, a holding apparatus 70 and a stacking apparatus 80 that stacks the manufactured flattened tube fins 30 in the plate thickness direction (vertical direction) are provided.

One example of the stacking of the flattened tube fins will be described. The flattened tube fin 30 having been cut into the predetermined dimension by the cutoff apparatus 60 is held by the holding apparatus 70 that maintains a holding state. Below the holding apparatus 70, the stacking apparatus 80 is provided that stacks the flattened tube fins 30 having been cut into the predetermined length by the cutoff apparatus 60.

The holding apparatus 70 has a pair of holding bodies 79 provided capable of approaching to/separating from each other between the side position of the metal strip 49 having the product width and the held position of the metal strip having the product width fed out of the inter-row slit apparatus 52.

The stacking apparatus 80 includes a plurality of stack pins 81 movable in the vertical direction so that they can be inserted into the cutaway portions 34 in the flattened tube fins 30 held by the holding apparatus 70 from below and a fin receiving portion 88 brought into contact with the lower surface of the lowermost flattened tube fin in the plurality of the flattened tube fins 30 inserted into the stack pin 81 and movable in the vertical direction separately from the vertical movement of the stack pins 81.

An example of the stacking apparatus does not have to be limited to those with the above structure but a magazine type, for example, can be also employed.

Moreover, in the present embodiment, the control unit 100 is provided and executes operation control of the first feeding apparatus 50 and the second feeding apparatus (gripper feeder 44).

The control unit 100 includes a central processing unit such as a CPU, a memory storing an operation program and the like.

Next, a feeding operation of a thin plate by the first feeding apparatus 50 in the press apparatus 48 and the second feeding apparatus 44 (gripper feeder 44) on the upstream side of the press apparatus 48 will be described on the basis of FIG. 6. Note that, in FIG. 6, the first feeding apparatus 50 is arranged in the mold 46, but as illustrated in FIG. 1, the first feeding apparatus 50 may be arranged on the downstream side in the conveying direction of the mold 46. Moreover in FIG. 6, the configuration of the feeding pin and the like of the feeding apparatus 50 and the configuration in the gripper feeder 44 and the like are omitted in illustration.

Figures 6A, 6B, 6C, 6D, 6E:
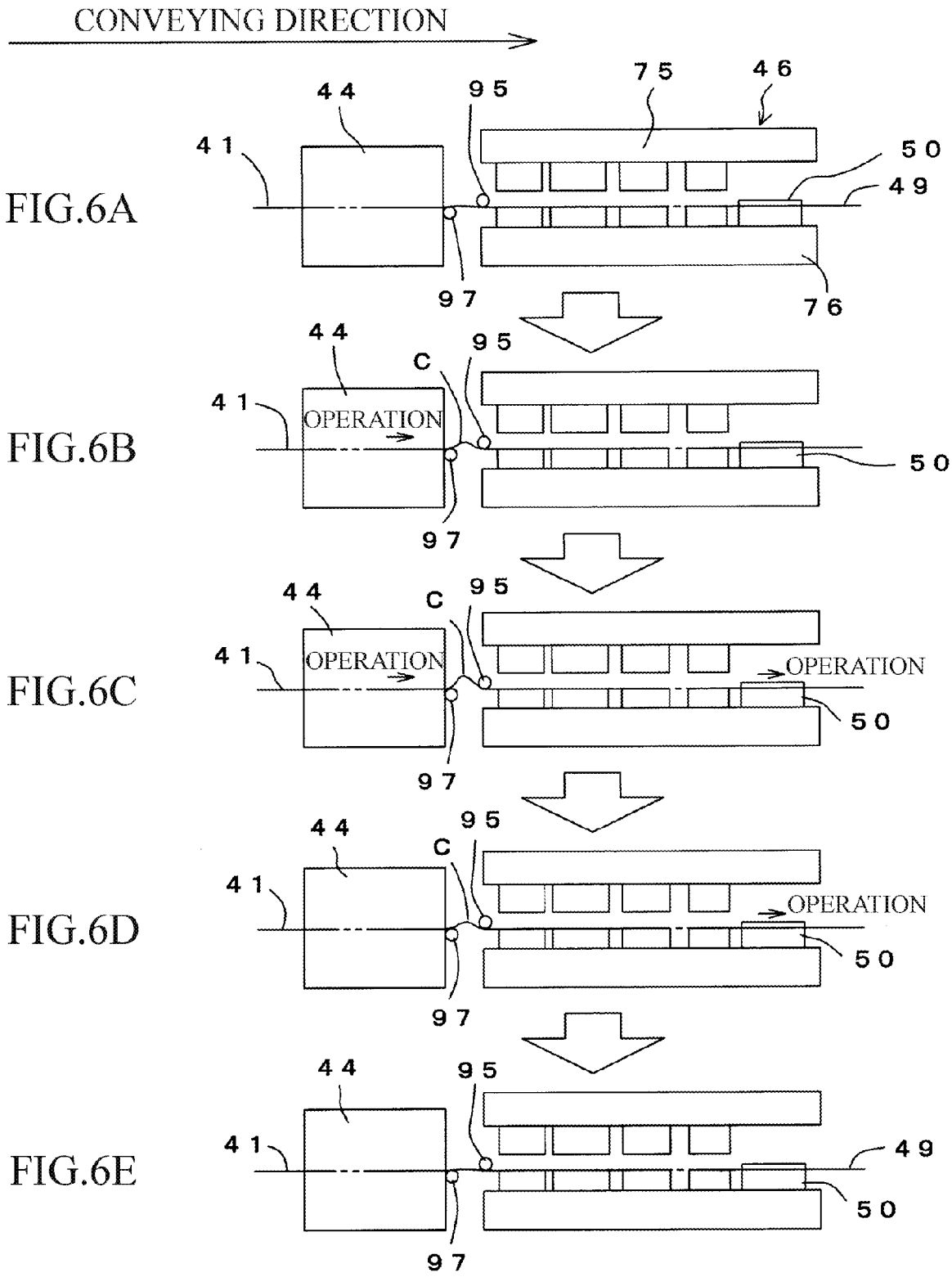
FIGS. 6A to 6E are an explanatory diagram illustrating an outline of conveyance by the first feeding apparatus and a second feeding apparatus (gripper feeder).
Figure 7:
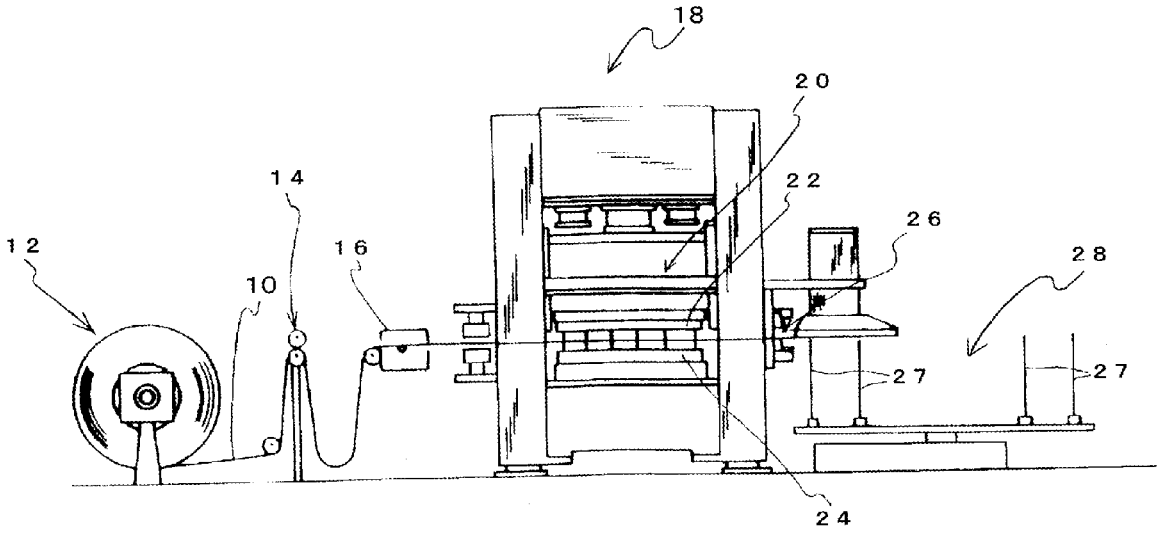
FIG.7 PRIOR ART
FIG. 7 is an explanatory diagram for explaining an outline configuration of a manufacturing apparatus for heat exchanger fins.

In FIG. 6A, a state where the upper die 75 and the lower die 76 of the mold 46 are mold-opened after press working is illustrated. Furthermore, in the subsequent FIGS. 6B to 6E, by conveying the machined metal strip in the conveying direction by the upper die 75 and the lower die 76, an unmachined portion of the thin plate 41 continuous to the machined metal strip 49 is arranged between the upper die 75 and the lower die 76.

In FIG. 6B, a state where the gripper feeder 44 which is an example of the second feeding apparatus first operates prior to the operation of the first feeding apparatus 50 is illustrated. If the thin plate 41 is fed into the mold 46 by the gripper feeder 44 at the time when the first feeding apparatus 50 has not started the feeding operation yet, the thin plate 41 generates a flexure C between the upper-surface holding member 95 and the lower-surface holding member 97. This flexure C is generated since a conveyance amount of the thin plate 41 by the gripper feeder 44 is suppressed by a friction force between the upper surface of the thin plate 41 and the upper-surface holding member 95 and a friction force between the lower surface of the thin plate 41 and the lower-surface holding member 97 when the thin plate 41 is not pulled by the first feeding apparatus 50.

In FIG. 6C, a state where the operation of the first feeding apparatus 50 is started later than the operation of the gripper feeder 44 is illustrated.

At this time, the conveying operation of the first feeding apparatus 50 is controlled by the control unit 100 so as to be synchronized with the conveying operation of the gripper feeder 44.

Since the first feeding apparatus 50 and the gripper feeder 44 both perform the conveyance simultaneously, the load of the metal strip 49 by the first feeding apparatus 50 can be reduced.

Moreover, also at this time, the flexure C is generated in the thin plate 41 between the upper-surface holding member 95 and the lower-surface holding member 97. Since the flexure C is generated closer to the upstream side than the press apparatus 48 (the mold 46 in the press apparatus 48), generation of flexure in the mold 46 can be prevented. That is, if some phase difference is generated between the respective conveyances of the first feeding apparatus 50 and the gripper feeder 44, there are problems that the thin plate 41 fluctuates in the mold 46 or interferes with the upper die 75, which gives a bad influence on the product quality. Thus, by generating the flexure C on the upstream side of the mold 46, the fluctuation or flexure in the thin plate 41 located in the mold 46 pulled by the first feeding apparatus 50 can be prevented.

In FIG. 6D, a state where the conveying operation of the gripper feeder 44 is finished prior to the conveying operation of the first feeding apparatus 50 is illustrated. Since the conveying operation of the gripper feeder 44 has been finished, the flexure C is eliminated by the pulling of the first feeding apparatus 50.

Then, in FIG. 6E, a state where the conveying operation of the first feeding apparatus 50 is also finished is illustrated. In this state, the thin plate 41 has been conveyed to a predetermined position in the mold 46, and the flexure C has been eliminated and a flat state has been realized. Subsequently, the mold 46 closes (not shown), the thin plate 41 is pressed, and the metal strip 49 is formed.

Note that, in the above-described embodiment, the first feeding apparatus 50 is configured to reciprocate the feed pin 55 by the reciprocating block 115.

However, the configuration of the first feeding apparatus 50 is not limited to that, but it may be so configured that a plurality of moving bodies, each having a feed pin, circulate within a vertical plane instead of reciprocation in the conveying direction (not shown). In this configuration, the moving body having completed the conveying operation goes around below the metal strip and moves in a direction opposite to the conveying direction and rises in the direction of the metal strip at the initial position of the conveyance.

Moreover, the above-described manufacturing apparatus has been described using a manufacturing apparatus for flattened tube fins as an example.

Figure 8:
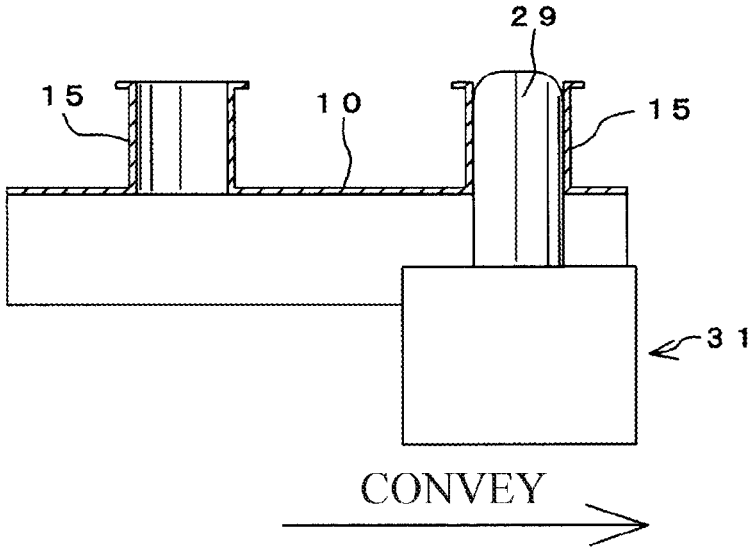
FIG. 8 is an explanatory diagram illustrating conveying of the metal strip by a feeding pin.
Figure 9:
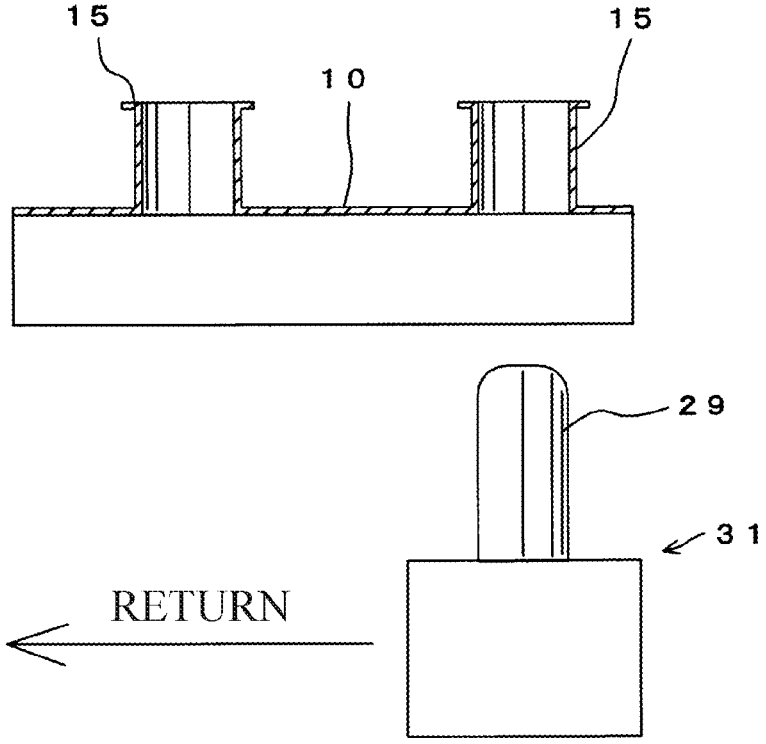
FIG. 9 is an explanatory diagram illustrating return of the feeding pin to an initial position after conveyance of the metal strip.

However, the present invention can be applied to a manufacturing apparatus for heat exchanger fins (See FIG. 8 and FIG. 9) in each of which collared through-holes into which the heat exchanger tube having a round-pipe shape is inserted are formed.

A preferred embodiment of the present invention has been exemplified and described as above but the present invention is not limited to this embodiment but it is needless to say that many modifications can be made within a range not departing from the spirit of the invention.

What is claimed is:

1. A manufacturing apparatus for heat exchanger fins, comprising:

a press apparatus having:

a mold that forms a metal strip by pressing a plurality of through-holes or a plurality of cutaway portions on a thin metal plate; and a first feeding apparatus arranged on a downstream side of the mold for conveying the metal strip formed by the mold to the downstream side in the conveying direction, a second feeding apparatus for conveying a thin metal plate before press working by the mold into the mold in conjunction with a conveying operation of the first feeding apparatus is provided on an upstream side of the press apparatus, the second feeding apparatus includes clampers for sandwiching the thin metal plate, the clampers repeat an operation of sandwiching the thin metal plate, conveying the same in the conveying direction, releasing the sandwiching at a predetermined position, and returning to an initial position while avoiding contact with the thin metal plate, and a control unit for controlling the first and second feeding apparatuses wherein the second feeding apparatus starts a conveying operation before the first feeding apparatus starts the conveying operation;

between the second feeding apparatus and the press apparatus, an upper-surface holding member in contact with an upper surface of the thin metal plate before entering the press apparatus and a lower-surface holding member in contact with a lower surface of the thin metal plate before entering the press apparatus are arranged with a predetermined distance therebetween in the conveying direction; and the positions of the upper-surface holding member and the lower-surface holding member in the vertical direction are set so that flexure is generated on the thin metal plate conveyed by the second feeding apparatus between the upper-surface holding member and the lower-surface holding member.

2. A manufacturing apparatus for heat exchanger fins, comprising:

a press apparatus having:

a mold that forms a metal strip by pressing a plurality of through-holes or a plurality of cutaway portions on a thin metal plate; and a first feeding apparatus arranged on a downstream side of the mold for conveying the metal strip formed by the mold to the downstream side in the conveying direction;

a second feeding apparatus for conveying a thin metal plate without through-holes before press working by the mold into the mold in conjunction with a conveying operation of the first feeding apparatus, said second feeding apparatus being provided on an upstream side of the press apparatus;

the second feeding apparatus includes clampers for sandwiching the thin metal plate without through-holes, the clampers repeat an operation of sandwiching the thin metal plate without through-holes, conveying the same in the conveying direction, releasing the sandwiching at a predetermined position, and returning to an initial position while avoiding contact with the thin metal plate without through-holes;

wherein the thin metal plate without through-holes is deflected on the upstream side of the mold and then the first feeding apparatus pulls the metal strip to eliminate a flexure for reducing the load on the metal strip; and a control unit for controlling the first and second feeding apparatuses wherein the second feeding apparatus starts a conveying operation before the first feeding apparatus starts the conveying operation.

3. The manufacturing apparatus for heat exchanger fins according to claim 2, wherein:

between the second feeding apparatus and the press apparatus, an upper-surface holding member in contact with an upper surface of the thin metal plate without through-holes before entering the press apparatus and a lower-surface holding member in contact with a lower surface of the thin metal plate without through-holes before entering the press apparatus are arranged with a predetermined distance therebetween in the conveying direction; and the positions of the upper-surface holding member and the lower-surface holding member in the vertical direction are set so the flexure is generated on the thin metal plate without through-holes conveyed by the second feeding apparatus between the upper-surface holding member and the lower-surface holding member.

* * * * *